US012807293B2

(12) United States Patent
Ebuchi

(10) Patent No.: US 12,807,293 B2
(45) Date of Patent: Nov. 24, 2026

(54) OUTBOARD MOTOR INCLUDING OUTPUT SHAFT HAVING HELICAL GEARS

(71) Applicant: YAMAHA HATSUDOKI KABUSHIKI KAISHA, Iwata (JP)

(72) Inventor: Jun Ebuchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 293 days.

(21) Appl. No.: 18/438,607

(22) Filed: Feb. 12, 2024

(65) Prior Publication Data

US 2024/0359787 A1 Oct. 31, 2024

(30) Foreign Application Priority Data

Apr. 26, 2023 (JP) ..... 2023-072161

(51) Int. Cl.
*B63H 20/32* (2006.01)
*B63H 20/12* (2006.01)

(52) U.S. Cl.
CPC ..... *B63H 20/32* (2013.01); *B63H 20/12* (2013.01); *B63H 2020/323* (2013.01)

(58) Field of Classification Search
CPC ..... B63H 20/32; B63H 20/12
See application file for complete search history.

(56) References Cited

U.S. PATENT DOCUMENTS 4,595,371 A * 6/1986 Heston ..... B63H 23/02 440/75
4,955,848 A * 9/1990 Kotajima ..... B60K 23/08 474/18
6,709,243 B1 * 3/2004 Tan ..... F04D 23/008 415/55.1
10,563,576 B2 * 2/2020 Sheridan ..... F01D 25/16
11,358,697 B1 * 6/2022 Sawyer ..... B63H 23/08
2010/0316323 A1 * 12/2010 Shibata ..... F16C 33/64 29/898.04

(Continued)

FOREIGN PATENT DOCUMENTS

JP S6440745 A 2/1989
JP 2015107678 A 6/2015
JP 2016-037256 A 3/2016

OTHER PUBLICATIONS

Official Communication issued in corresponding European Patent Application No. 24153178.9, mailed on Sep. 17, 2024, 11 pages.

*Primary Examiner* — Jess Whittington
(74) *Attorney, Agent, or Firm* — Keating & Bennett, LLP

(57) ABSTRACT

An outboard motor includes an electric motor including an output shaft extending in an upper-lower direction, a first helical gear including a first gear shaft extending in the upper-lower direction and including a first end connected to the output shaft of the electric motor, a first bearing to support the first end of the first gear shaft, a second bearing to support a second end of the first gear shaft, a second helical gear including a second gear shaft extending in the upper-lower direction and meshing with the first helical gear, and a case accommodating at least the first helical gear, the first bearing, and the second bearing. At least one of the first bearing or the second bearing defines a fixing mechanism to fix the first gear shaft at a predetermined position in the upper-lower direction with respect to the case when the first and second helical gears rotate.

7 Claims, 4 Drawing Sheets

(56) References Cited

U.S. PATENT DOCUMENTS

| | | | | |
|---|---|---|---|---|
| 2015/0098797 | A1* | 4/2015 | Shirakawa | F16C 33/585 415/111 |
| 2016/0039510 | A1* | 2/2016 | Shomura | B63H 20/14 440/6 |
| 2016/0375974 | A1* | 12/2016 | Loftus, Jr. | B63H 20/20 440/75 |
| 2020/0318698 | A1* | 10/2020 | Bosscher | F16D 48/06 |
| 2023/0019353 | A1* | 1/2023 | Reynolds | F16C 33/7889 |
| 2023/0219409 | A1* | 7/2023 | Okuda | B60K 1/02 180/65.6 |
| 2024/0401683 | A1* | 12/2024 | Matsuda | B60K 1/00 |

* cited by examiner

OUTBOARD MOTOR INCLUDING OUTPUT SHAFT HAVING HELICAL GEARS

CROSS REFERENCE TO RELATED APPLICATIONS

This application claims the benefit of priority to Japanese Patent Application No. 2023-072161 filed on Apr. 26, 2023. The entire contents of this application are hereby incorporated herein by reference.

BACKGROUND OF THE INVENTION

1. Field of the Invention

The technologies disclosed herein relate to an outboard motor and a boat.

2. Description of the Related Art

A boat is provided with a hull and an outboard motor mounted to a rear portion of the hull. The outboard motor is a device that generates thrust to propel the boat. The outboard motor has a drive source, a propeller, and a transmission mechanism that has a propeller shaft and transmits the drive power of the drive source to the propeller.

There has been disclosed an outboard motor including an electric motor including an output shaft arranged along an upper-lower direction, a gear mechanism connected to the output shaft of the electric motor, and a case including a housing chamber accommodating the gear mechanism and oil. The gear mechanism has two gears that rotate around rotation shafts along an upper-lower direction and mesh with each other (hereinafter referred to as "vertical shaft rotation gears"), and the gear shaft of one of the vertical shaft rotation gears is connected to the output shaft of the electric motor (see, e.g., JP 2016-37256 A).

In the outboard motor of the above conventional technology, when the two vertical shaft rotation gears constituting the gear mechanism are helical gears, there is a risk that the thrust load generated by the rotation of the first and second helical gears may be transmitted to the output shaft of the electric motor.

This issue is not limited to electric motors but is common to outboard motors in which a transmission mechanism with gears connected to the output shaft of an engine or other drive source is accommodated in a housing chamber of a case.

SUMMARY OF THE INVENTION

The present specification discloses technologies that are able to solve one or more of the above-mentioned problems.

The technologies disclosed herein can be implemented in the following aspects.

An outboard motor according to a preferred embodiment of the present invention includes an electric motor including an output shaft extending in an upper-lower direction, a first helical gear including a first gear shaft extending in the upper-lower direction and including a first end connected to the output shaft of the electric motor, a first bearing to support the first end of the first gear shaft, a second bearing to support a second end of the first gear shaft, a second helical gear including a second gear shaft extending in the upper-lower direction and meshing with the first helical gear, and a case accommodating at least the first helical gear, the first bearing, and the second bearing, wherein at least one of the first bearing or the second bearing defines a fixing mechanism to fix the first gear shaft at a predetermined position in the upper-lower direction with respect to the case when the first and second helical gears rotate. Accordingly, compared to a configuration without the fixing mechanism, the thrust load generated by the rotation of the first and second helical gears can be reduced or prevented from being transmitted to the output shaft of the electric motor.

In the fixing mechanism including the second bearing, the second bearing may include a first angular bearing and a second angular bearing positioned back to back with respect to the first angular bearing, and the first angular bearing and the second angular bearing may be fixed to the case and to the second end of the first gear shaft in the upper-lower direction. Thus, the outboard motor can use the angular bearings to reduce or prevent the thrust load generated by the rotation of the first and second helical gears from being transmitted to the output shaft of the electric motor.

In the above outboard motor, the second bearing may include a double row angular bearing. This configuration can utilize the double row angular bearings to reduce or prevent the thrust load generated by the rotation of the first and second helical gears from being transmitted to the output shaft of the electric motor.

In the above outboard motor, the case may include a contact surface that contacts one end surface of the double row angular bearing in the upper-lower direction, and the second end of the first gear shaft may include a protruding portion that sandwiches the double row angular bearing with the contact surface in the upper-lower direction. This configuration can effectively reduce or prevent the thrust load generated by the rotation of the first and second helical gears from being transmitted to the output shaft of the electric motor.

In the fixing mechanism including the first bearing and the second bearing, the first bearing may include a first tapered roller bearing fixed to the case, the second bearing may include a second tapered roller bearing fixed to the case, and a direction of inclination of a rotation shaft of a tapered roller of the first tapered roller bearing and a direction of inclination of a rotation shaft of a tapered roller of the second tapered roller bearing may be symmetrical with respect to the first helical gear. This configuration can utilize the tapered roller to reduce or prevent the thrust load generated by the rotation of the first and second helical gears from being transmitted to the output shaft of the electric motor.

In the above outboard motor, the first tapered roller bearing and the second tapered roller bearing may be inclined such that the closer the first tapered roller bearing and the second tapered roller bearing are to each other, the greater a distance between the rotation shaft of the tapered roller and the first gear shaft. This configuration can effectively reduce or prevent the thrust load generated by the rotation of the first and second helical gears from being transmitted to the output shaft of the electric motor.

The above outboard motor may further include a motor case, separate from the case, to accommodate the electric motor.

In the above outboard motor, the case may further accommodate the electric motor.

An outboard motor according to another preferred embodiment of the present invention includes a drive source, a first gear including a first gear shaft including a first end connected to an output shaft of the drive source, the first gear being a helical gear or a bevel gear, a second gear including a second gear shaft including a first end, the second gear meshing with the first gear and being a helical gear or bevel gear, a first bearing to support the first end of the first gear shaft or the first end of the second gear shaft, a second bearing to support a second end of the first gear shaft or a second end of the second gear shaft, and a case to accommodate at least the first gear, the second gear, the first bearing, and the second bearing, wherein at least the first bearing or the second bearing defines a fixing mechanism to fix the first gear shaft or the second gear shaft to the case at a predetermined position in an axial direction of the first gear shaft or an axial direction of the second gear shaft when the first gear and the second gear rotate. Thus, the outboard motor can reduce or prevent the thrust load generated by the rotation of the first and second gears from being transmitted to the output shaft of the electric motor, compared to a configuration without a fixing mechanism.

The technologies disclosed herein can be implemented in various aspects, including, e.g., outboard motors, boats provided with outboard motors and hulls, among other configurations and apparatuses.

According to the outboard motors disclosed herein, it is possible to reduce or prevent the thrust load generated by the rotation of the first and second helical gears from being transmitted to the output shaft of the drive source (electric motor).

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
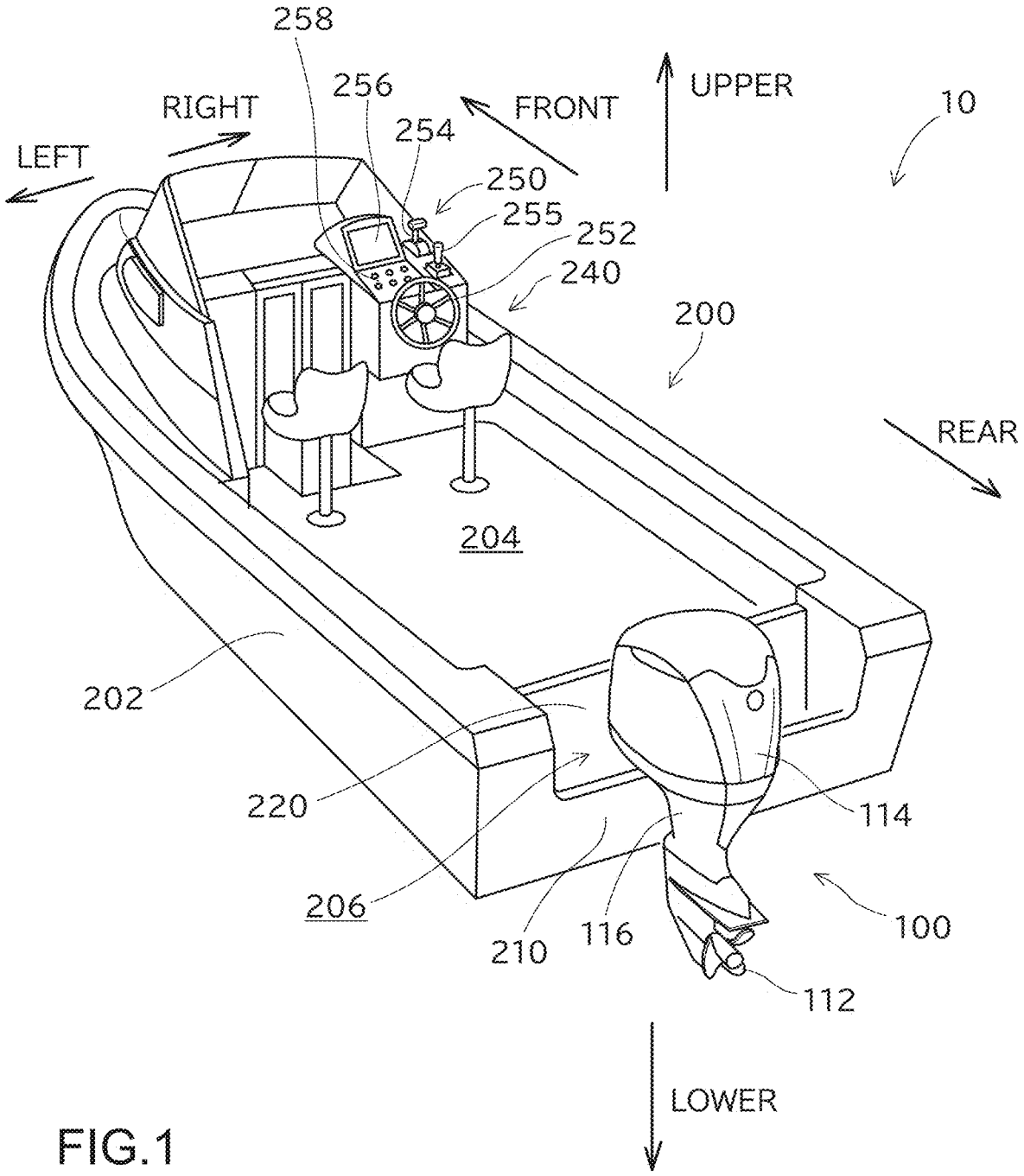
FIG. 1 is a perspective view schematically illustrating a configuration of a boat according to a first preferred embodiment of the present invention.

FIG. 1 is a perspective view schematically illustrating a configuration of a boat 10 according to a first preferred embodiment of the present invention. FIG. 1 and other figures described below show arrows representing each direction with respect to the position of the boat 10. More specifically, each drawing shows arrows representing the front direction (FRONT), rear direction (REAR), left direction (LEFT), right direction (RIGHT), upper direction (UPPER), and lower direction (LOWER), respectively. The front-rear direction, left-right direction, and upper-lower (vertical) direction are orthogonal to each other.

The boat 10 includes a hull 200 and an outboard motor 100. In this preferred embodiment, the boat 10 includes only one outboard motor 100, but the boat 10 may include a plurality of outboard motors 100.

The hull 200 is a portion of the boat 10 for occupants to ride. The hull 200 includes a hull main body 202 including a living space 204, a pilot seat 240 installed in the living space 204, and an operating device 250 installed near the pilot seat 240. The operating device 250 steers the boat and includes, e.g., a steering wheel 252, a shift/throttle lever 254, a joystick 255, a monitor 256, and an input device 258. The hull 200 includes a partition wall 220 to partition the rear end of the living space 204 and a transom 210 positioned at the rear end of the hull 200. In the front-rear direction, a space 206 is provided between the transom 210 and the partition wall 220.

Figure 2:
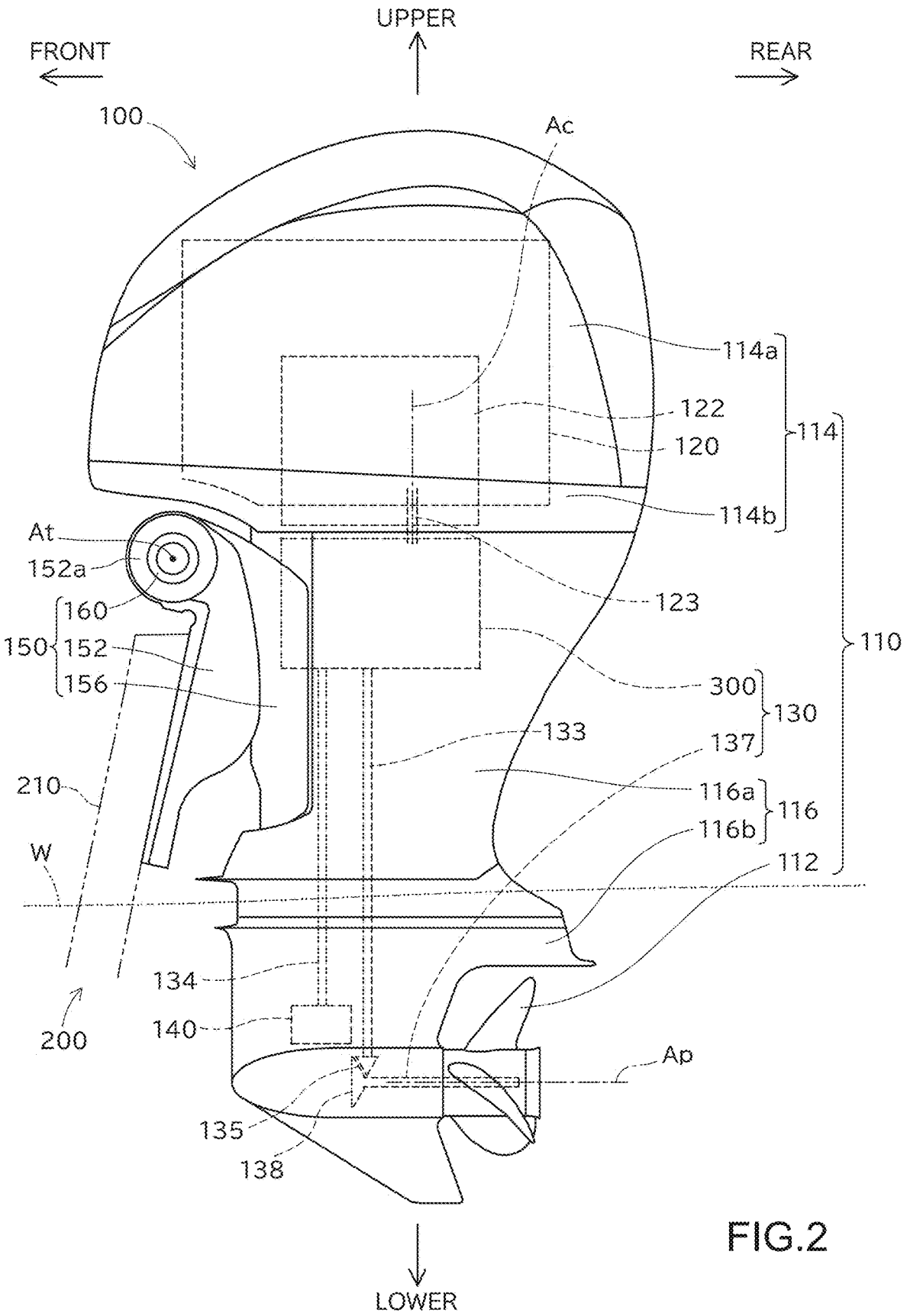
FIG. 2 is a side view schematically illustrating a configuration of an outboard motor according to the first preferred embodiment of the present invention.

FIG. 2 is a side view schematically illustrating a configuration of an outboard motor 100. The outboard motor 100 in the reference attitude will be described below unless otherwise specified. The reference attitude is an attitude in which the rotation axis Ac of the output shaft 123 of the electric motor 122, which will be described below, extends in the upper-lower direction and the rotation axis Ap of the propeller shaft 137, which will be described below, extends in the front-rear direction. The front-rear direction, the left-right direction, and the upper-lower direction are respectively defined based on the outboard motor 100 in the reference attitude.

The outboard motor 100 generates thrust to propel the boat 10. The outboard motor 100 is attached to the transom 210 at a rear portion of the hull 200. The outboard motor 100 includes an outboard motor main body 110 and a suspension device 150.

The outboard motor main body 110 includes a motor assembly 120, a transmission mechanism 130, a propeller 112, a cowl 114, a casing 116, a water pump 140, and a pump shaft 134.

The cowl 114 is a housing located on top of the outboard motor main body 110. The cowl 114 includes an upper cowl **114*a* defining the upper portion of the cowl 114 and a lower cowl 114*b* defining the lower portion of the cowl 114. The upper cowl 114*a* is detachably attached to the lower cowl 114*b*. The casing 116 is a housing located below the cowl 114 and provided in the lower portion of the outboard motor main body 110. The casing 116 includes a lower case 116*b* and an upper case 116*a*. The lower case 116*b* accommodates at least a portion of the drive shaft 133 and the propeller shaft 137 described below. The lower case 116*b* is connected to the upper case 116*a* so as to be pivotable around the drive shaft 133. The upper case 116*a* is located above the lower case 116*b* and accommodates a gearbox assembly 300** described below.

A motor assembly 120 is accommodated within the cowl 114. The motor assembly 120 includes an electric motor 122. The electric motor 122 is an example of a drive source. The electric motor 122 includes an output shaft 123 that outputs the drive power generated by the electric motor 122.

The transmission mechanism 130 transmits the driving force of the electric motor 122 to the propeller 112. At least a portion of the transmission mechanism 130 is accommodated in the casing 116. The transmission mechanism 130 includes a gearbox assembly 300, a drive shaft 133, and a propeller shaft 137.

The propeller shaft 137 is a rod-shaped member extending in a forward and backward extending below the outboard motor main body 110. The propeller shaft 137 rotates with the propeller 112. The front end of the propeller shaft 137 is accommodated in the lower case **116*b*, and the rear end of the propeller shaft 137 protrudes rearward from the lower case 116*b*. The front end of the propeller shaft 137 includes a gear 138**.

The gearbox assembly 300 is connected to the output shaft 123 of the electric motor 122 and the drive shaft 133.

The gearbox assembly 300 reduces the driving force of the electric motor 122 and transmits the reduced driving force to the propeller shaft 137. This allows the electric motor 122 to rotate at a desired torque. The configuration of the gearbox assembly 300 will be described in detail below.

The propeller 112 is a rotor including a plurality of blades and is attached to the rear end of the propeller shaft 137. The propeller 112 rotates along with the rotation of the propeller shaft 137 around the rotation axis Ap. The propeller 112 generates thrust by rotating. As mentioned above, since the lower case 116*b* is pivotable, the propeller 112 pivots about the drive shaft 133 along with the lower case 116*b*. Therefore, the boat 10 is steered by pivoting the lower case 116*b*.

The water pump 140 pumps water from outside the outboard motor 100, e.g., to cool the electric motor 122. The pump shaft 134 extends in an upper-lower direction. The pump shaft 134 is driven by the drive power of the electric motor 122 and transmits power to the water pump 140. The water pump 140 is driven by the driving force of the electric motor 122 transmitted by the pump shaft 134.

The suspension device 150 connects the outboard motor main body 110 to the hull 200. The suspension device 150 includes a pair of left and right clamp brackets 152, a tilt shaft 160, and a swivel bracket 156.

The pair of left and right clamp brackets 152 are disposed behind the hull 200 in a state separated from each other in the left-right direction and are fixed to the transom 210 of the hull 200 by using, e.g., bolts. Each clamp bracket 152 includes a cylindrical supporting portion 152*a* provided with a through-hole extending in the left-right direction.

The tilt shaft 160 is a rod-shaped member and is rotatably supported within the through-hole in the supporting portion 152*a* of the clamp bracket 152. The tilt axis At, which is the centerline of the tilt shaft 160, defines a horizontal (left-right) axis during the tilting operation of the outboard motor 100.

The swivel bracket 156 is sandwiched between the pair of clamp brackets 152 and is supported by the supporting portion 152*a* of the clamp brackets 152 via the tilt shaft 160 so as to be rotatable around the tilt axis At. The swivel bracket 156 is driven to rotate about the tilt axis At with respect to the clamp bracket 152 by a tilt device (not shown) that includes an actuator, such as a hydraulic cylinder, for example.

When the swivel bracket 156 rotates about the tilt axis At with respect to the clamp bracket 152, the outboard motor main body 110 supported by the swivel bracket 156 also rotates about the tilt axis At. This achieves the tilting operation of rotating the outboard motor main body 110 in the upper-lower direction with respect to the hull 200. By this tilting operation, the outboard motor 100 can change the angle of the outboard motor main body 110 around the tilt axis At in the range from the tilt-down state in which the propeller 112 is located under the water (the state in which the outboard motor 100 is in the reference attitude) to the tilt-up state in which the propeller 112 is located above the water surface. Trimming operation to adjust the attitude of the boat 10 during travel can also be performed by adjusting the angle around the tilt axis At of the outboard motor main body 110.

Figure 3:
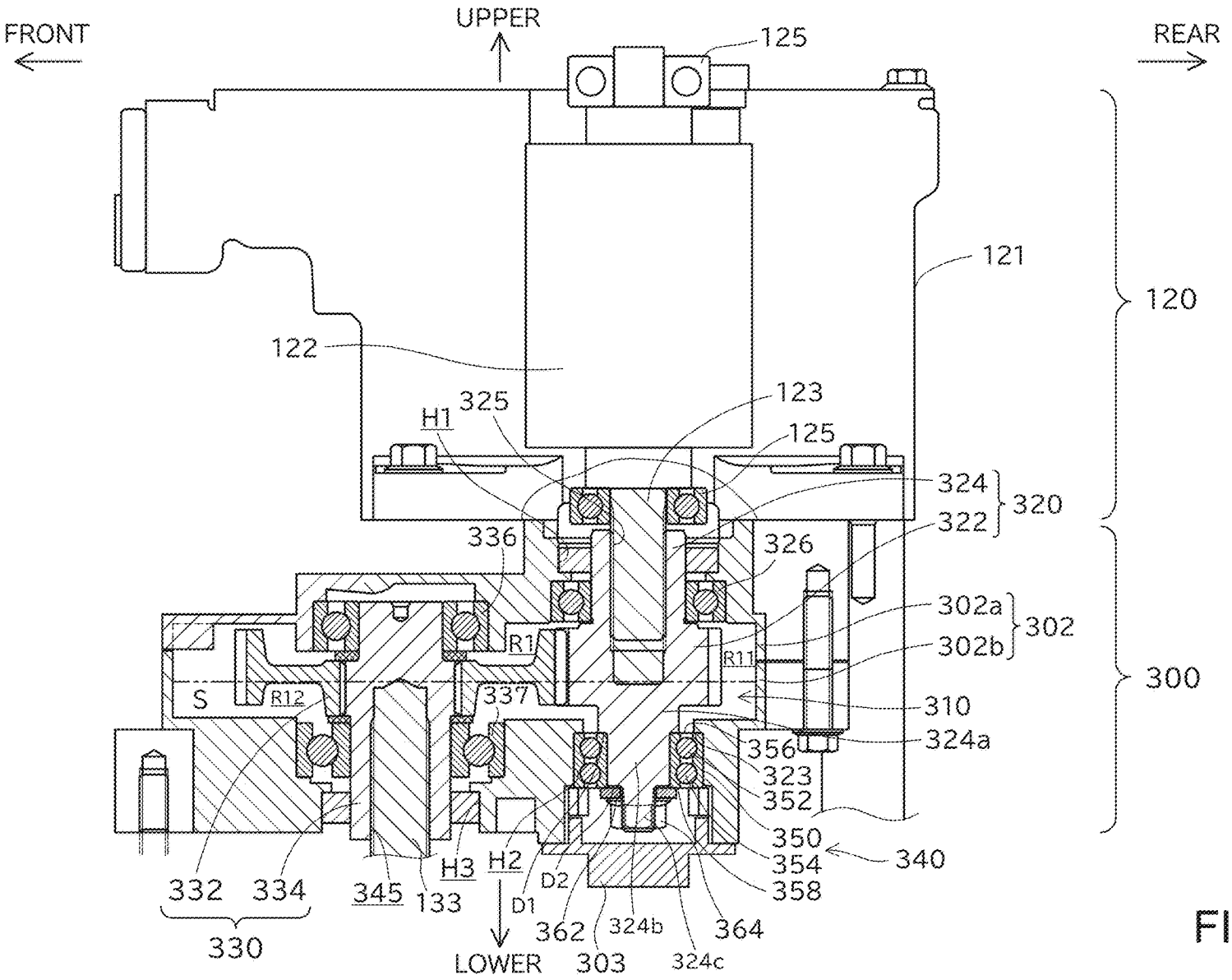
FIG. 3 is an explanatory view schematically illustrating an internal configuration of a motor assembly and a gearbox assembly.

FIG. 3 is an explanatory view schematically illustrating an internal configuration of a motor assembly 120 and a gearbox assembly 300. As shown in FIG. 3, the motor assembly 120 and the gearbox assembly 300 are separated from each other and are each accommodated in an individual case.

The motor assembly 120 includes the electric motor 122 as described above and a motor case 121 that supports the electric motor 122. The electric motor 122 is placed vertically in the motor case 121. Vertical placement means that the output shaft 123 (rotation axis Ac) of the electric motor 122 is arranged in an attitude in which it extends in the upper-lower direction. The upper and lower ends of the output shaft 123 are rotatably supported by a motor bearing 125 fixed to the motor case 121, respectively.

The gearbox assembly 300 includes a primary reduction gear mechanism 310 and a gear case 302. The gear case 302 is an example of the case in the claims.

The gear case 302 includes a housing chamber R1 that accommodates the primary reduction gear mechanism 310 and oil S. The gear case 302 includes an upper gear case 302*a* and a lower gear case 302*b* combined in the upper-lower direction to define the housing chamber R1. The housing chamber R1 includes an input side region R11 and an output side region R12. The input side region R11 is the region of the housing chamber R1 that is located directly below the electric motor 122. The output side region R12 is a region of the housing chamber R1 that is located forward of the input side region R11. The gear case 302 is provided with an input through-hole H1 opening upward from the input side region R11, a through-hole H2 opening downward from the input side region R11, and an output through-hole H3 opening downward from the output side region R12.

The primary reduction gear mechanism 310 includes an input gear 320, an upper input bearing 326, a lower input bearing 350, an output gear 330, an upper output bearing 336, and a lower output bearing 337. The input gear 320, the upper input bearing 326, and the lower input bearing 350 are accommodated in the input side region R11 of the gear case 302. The output gear 330, the upper output bearing 336, and the lower output bearing 337 are accommodated in the output side region R12 of the gear case 302.

The input gear 320 includes an input gear shaft 324 extending in the upper-lower direction, and the upper end of the input gear shaft 324 is connected to the output shaft 123 of the electric motor 122. In this preferred embodiment, the input gear 320 is a helical gear. The input gear 320 is an example of a first helical gear, and the input gear shaft 324 is an example of a first gear shaft. Specifically, the input gear 320 includes an input gear shaft 324 and an input gear body 322 fixed to the input gear shaft 324. The input gear body 322 and the input gear shaft 324 may be separate from each other or may be integral. The input gear shaft 324 is arranged in an attitude in which it extends along the upper-lower direction. An insertion hole 325 is provided in the upper end of the input gear shaft 324. The output shaft 123 of the electric motor 122 protrudes into the input side region R11 through the above-mentioned input through-hole H1 of the gear case 302 and is inserted into and fixed to the insertion hole 325 of the input gear shaft 324. Thus, the input gear 320 rotates integrally with the output shaft 123 around the rotation axis Ac.

The upper input bearing 326 is located on the upper side of the input gear body 322, is fixed to the gear case 302 (upper gear case 302*a*), and rotatably supports the upper end of the input gear shaft 324. The lower input bearing 350 is located on the lower side of the input gear body 322, is fixed to the gear case 302 (lower gear case 302*b*), and rotatably supports the lower end of the input gear shaft 324. The through-hole H2 of the gear case 302 is sealed by a cap 303. The upper input bearing 326 is an example of a first bearing, and the lower input bearing 350 is an example of a second bearing.

The output gear 330 includes an output gear shaft 334 extending in the upper-lower direction and meshes with the input gear 320. In this preferred embodiment, the output gear 330 is a helical gear. The output gear 330 is an example of a second helical gear, and the output gear shaft 334 is an example of a second gear shaft. Specifically, the output gear 330 includes an output gear shaft 334 and an output gear body 332 fixed to the output gear shaft 334. The output gear body 332 and the output gear shaft 334 may be separate from each other or may be integral. The output gear shaft 334 is arranged in an attitude in which it extends along the upper-lower direction. An insertion hole 345 is provided in the lower end of the output gear shaft 334. The drive shaft 133 protrudes into the output side region R12 through the above-mentioned output through-hole H3 of the gear case 302 and is inserted into and fixed to the insertion hole 345 of the output gear shaft 334. Thus, the output gear 330 rotates integrally with the drive shaft 133.

The upper output bearing 336 is located on the upper side of the output gear body 332, is fixed to the gear case 302 (upper gear case 302*a*), and rotatably supports the upper end of the output gear shaft 334. The lower output bearing 337 is located on the lower side of the output gear body 332, is fixed to the gear case 302 (lower gear case 302*b*), and rotatably supports the lower end of the output gear shaft 334.

With the above configuration, the input gear 320 rotates by receiving driving force from the output shaft 123 of the electric motor 122. The output gear 330 rotates in conjunction with the input gear 320, and the drive shaft 133 rotates as the output gear 330 rotates. In this preferred embodiment, the number of teeth of the input gear 320 is greater than that of the output gear 330. Therefore, the drive shaft 133 rotates at a reduced speed relative to the rotational speed of the output shaft 123 by the ratio of the number of teeth of the input gear 320 to the number of teeth of the output gear 330 (reduction ratio). Thus, the primary reduction gear mechanism 310 transmits the driving force of the electric motor 122 to the drive shaft 133 while reducing the rotational speed of the electric motor 122.

The boat 10 includes a fixing mechanism 340 to fix the input gear shaft 324 of the input gear 320 at a predetermined position in the upper-lower direction with respect to the gear case 302. As shown in FIG. 3, the fixing mechanism 340 includes the lower input bearing 350 being fixed to the gear case 302 and to the lower end of the input gear shaft 324 in the upper-lower direction.

Specifically, the lower input bearing 350 is a double row angular bearing. The double-row angular bearing includes a structure in which the inner and outer rings are integrated by combining a pair of single-row angular bearings 352, 354 that can receive thrust loads in mutually opposite directions. Angular bearings are non-separating bearings, in which the straight line connecting the contact points between the balls and the inner and outer rings has a certain angle (contact angle) to the radial direction. The lower gear case 302*b* includes a contact surface 323 that contacts the upper surface 356 of the lower input bearing 350. In the lower gear case 302*b*, a protrusion that protrudes inward in the radial direction is provided all around the inner circumference of the through-hole H2, and the lower surface of this protrusion is the above contact surface 323.

The lower end of the input gear shaft 324 includes a large diameter portion 324*a*, a medium diameter portion 324*b*, and a small diameter portion 324*c*. The medium diameter portion 324*b* is located below the large diameter portion 324*a*, and the small diameter portion 324*c* is located below the medium diameter portion 324*b*. The outer diameter of the medium diameter portion 324*b* is smaller than the outer diameter of the large diameter portion 324*a*, and a first stepped surface D1 is provided between the medium diameter portion 324*b* and the large diameter portion 324*a*. The lower input bearing 350 is fitted into the medium diameter portion 324*b*, and the upper surface 356 of the lower input bearing 350 is in contact with the first stepped surface D1 in the upper-lower direction together with the contact surface 323 of the gear case 302.

The outer diameter of the small diameter portion 324*c* of the input gear shaft 324 is smaller than the outer diameter of the medium diameter portion 324*b*, and a second stepped surface D2 is provided between the small diameter portion 324*c* and the medium diameter portion 324*b*.

A washer 362 as an annular member is fitted into the small diameter portion 324*c*. The upper surface of the washer 362 is in contact with the lower surface 358 of the lower input bearing 350 in the upper-lower direction. The washer 362 is fixed to the input gear shaft 324 (small diameter portion 324*c*) by a fastening mechanism. Specifically, a male thread is formed on the outer circumference of the small diameter portion 324*c*, and a nut 364 is screwed onto the small diameter portion 324*c*. The washer 362 is sandwiched in the upper-lower direction between the lower surface 358 of the lower input bearing 350 and the second stepped surface D2 of the input gear shaft 324 and the upper surface of the nut 364. As a result, the input gear shaft 324, the gear case 302, and the lower input bearing 350 are fastened together by the fastening mechanism. The portion of the washer 362 protruding radially outward from the medium diameter portion 324*b* is an example of the protruding portion in the claims.

With the above configuration, the input gear shaft 324 is immovably fixed to the lower input bearing 350 in the upper-lower direction, and this lower input bearing 350 is immovably fixed to the electric motor 122 side by the contact surface 323 of the gear case 302. The lower input bearing 350 supporting the input gear shaft 324 is a double row angular bearing and thus absorbs thrust loads in both upper and lower directions generated on the input gear shaft 324 as the input gear 320 and output gear 330 rotate. Therefore, the fixing mechanism 340 can fix the input gear shaft 324 of the input gear 320 at a predetermined position in the upper-lower direction with respect to the gear case 302. Therefore, thrust loads are restrained from being applied to the output shaft 123 of the electric motor 122. As a result, the motor bearing 125 supporting, e.g., the electric motor 122 does not need to be a large bearing that can withstand a relatively large load, and an increase in the size of the motor case 121 can be reduced or prevented.

It should be noted that, in this specification, axes, members, and the like extending in the front-rear direction need not necessarily be parallel to the front-rear direction. Axes and members extending in the front-rear direction include axes and members that are inclined in the range of +45° to the front-rear direction. Similarly, axes and members extending in the upper-lower direction include axes and members inclined within a range of +45° to the upper-lower direction, and axes and members extending in the left-right direction include axes and members inclined within a range of +45° to the left-right direction.

Figure 4:
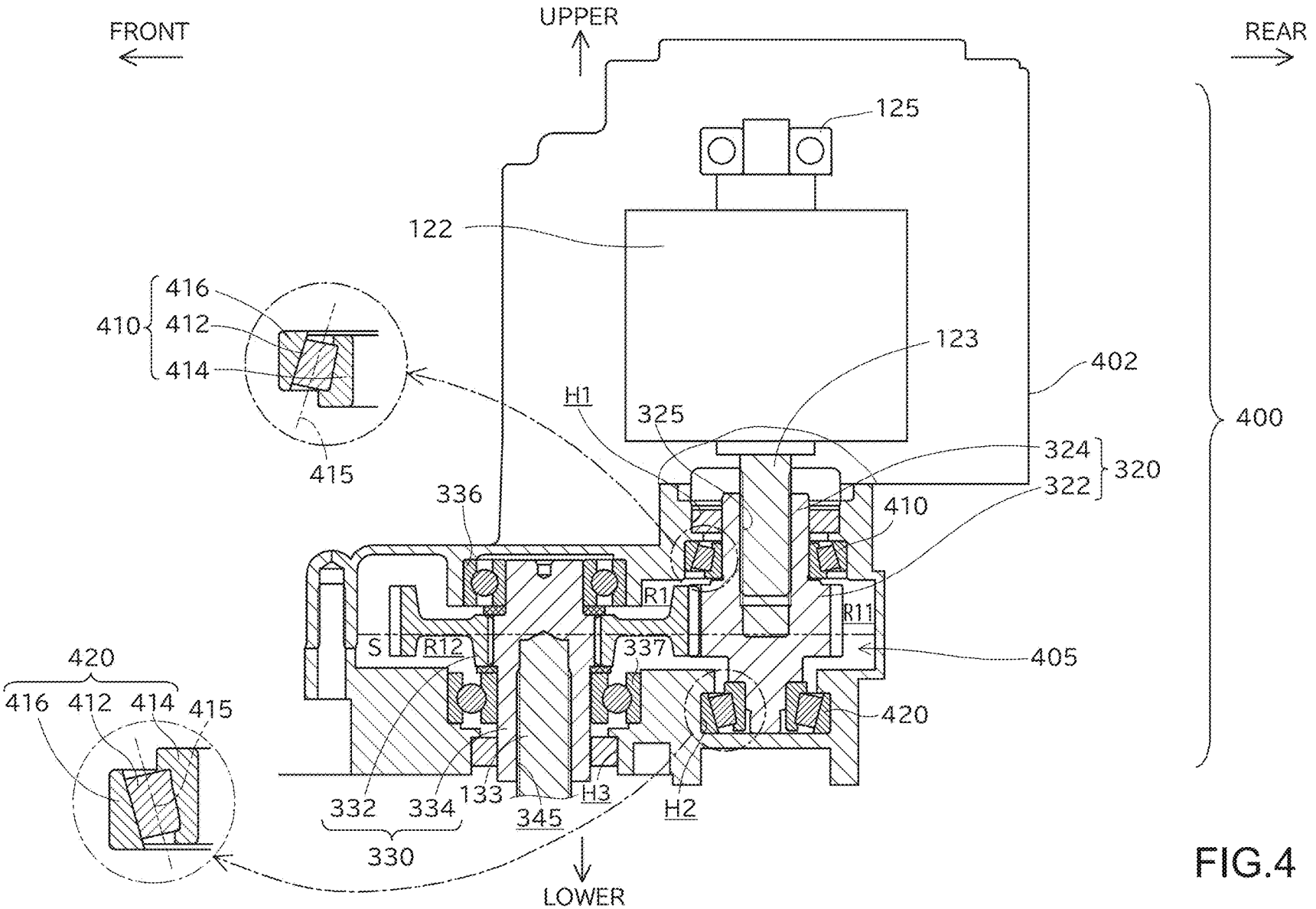
FIG. 4 is an explanatory view schematically illustrating an internal configuration of a motor-gear integrated assembly according to a second preferred embodiment of the present invention.

FIG. 4 is an explanatory view schematically illustrating an internal configuration of a motor-gear integrated assembly 400 according to a second preferred embodiment of the present invention. In the following, the description of the configuration of the boat 10 of the second preferred embodiment, which is identical to that of the boat 10 of the first preferred embodiment described above, will be omitted as appropriate.

This second preferred embodiment differs from the first preferred embodiment above in that it includes a motor-gear integrated assembly 400 instead of a motor assembly 120 and a gearbox assembly 300. The motor-gear integrated assembly 400 includes an electric motor 122 and a primary reduction gear mechanism 405 accommodated in an integral case 402. The integral case 402 is an example of a case.

The upper portion of the integral case 402 accommodates the electric motor 122 and a motor bearing 125 that supports the upper end of the output shaft 123 of the electric motor 122. The lower end of the output shaft 123 is supported by the first tapered roller bearing 410 described below, which is provided in the primary reduction gear mechanism 405.

The primary reduction gear mechanism 405 is accommodated in the lower portion of the integral case 402. The primary reduction gear mechanism 405 differs from the primary reduction gear mechanism 310 of the first preferred embodiment in the configuration of the bearing supporting the input gear 320. The primary reduction gear mechanism 405 includes a first tapered roller bearing 410 and a second tapered roller bearing 420 instead of the upper input bearing 326 and the lower input bearing 350. In the second preferred embodiment, the first tapered roller bearing 410 and the second tapered roller bearing 420 define the fixing mechanism.

The first tapered roller bearing 410 is fixed within the input through-hole H1 of the integral case 402 and supports the upper end of the input gear shaft 324 of the input gear 320. The first tapered roller bearing 410 includes a tapered roller 412, an inner ring 414, and an outer ring 416 and is designed so that the raceways of the inner ring 414 and outer ring 416 and the apex of the tapered roller 412 intersect at a point on the centerline of the first tapered roller bearing 410 (the center axis of the input gear shaft 324). The second tapered roller bearing 420 is fixed in the input through-hole H1 of the integral case 402 and supports the lower end of the input gear shaft 324 of the input gear 320. The second tapered roller bearing 420 has the same configuration as the first tapered roller bearing 410. However, the first tapered roller bearing 410 and the second tapered roller bearing 420 are inclined such that the closer the first tapered roller bearing and the second tapered roller bearing are to each other, the greater a distance between the rotation axis 415 of the tapered roller 412 and the input gear shaft 324.

With the above configuration, the first tapered roller bearing 410 and the second tapered roller bearing 420 absorb the thrust load generated on the input gear shaft 324 in the upper-lower direction while immovably supporting the input gear shaft 324 in the upper-lower direction. Therefore, the input gear shaft 324 of the input gear 320 can be fixed to the integral case 402 at a predetermined position in the upper-lower direction.

The techniques disclosed herein are not limited to the above-described preferred embodiments and may be modified in various ways without departing from the gist of the present invention, including the following modifications.

The configuration of the boat 10 and outboard motor 100 of the above preferred embodiments are only examples and are variously changed. For example, in the above preferred embodiments, the drive shaft 133 is positioned in front of the output shaft 123, but the drive shaft 133 may be positioned behind the output shaft 123. In the above preferred embodiments, an electric motor 122 with the output shaft 123 disposed along the upper-lower direction is shown as the drive source, but the drive source may be an electric motor with the output shaft 123 disposed along a direction other than the upper-lower direction (e.g., horizontal direction) or an engine such as internal combustion engine.

In the above preferred embodiments, a primary reduction gear mechanism 310 is illustrated as the transmission mechanism, but the transmission mechanism may be any other gear mechanism (such as a speed change mechanism). The gear mechanism may include two or more helical gears that rotate around a rotation shaft along the upper-lower direction and mesh with each other. The electric motor 122 is placed horizontally in the motor case 121. Horizontal placement means that the electric motor 122 is placed in an attitude in which the output shaft 123 (rotation axis Ac) of the electric motor 122 extends in the horizontal direction. Also, the first and second gears are not limited to helical gears but may also be bevel gears. Furthermore, the first gear and the second gear may rotate around a rotation shaft along the horizontal direction.

In the first preferred embodiment above, the lower input bearing 350 is a double row angular bearing, but it may be a pair of single-row angular bearings that can receive thrust loads in mutually opposite directions. The lower input bearing 350 may also be a deep groove bearing. In the above preferred embodiments, the protruding portion of the washer 362 is illustrated as the protruding portion of the second end of the first gear shaft, but it may be, e.g., a protruding portion protruding radially outward from the outer circumference of the input gear shaft 324 and integral with the input gear shaft 324.

The fixing mechanism of the second preferred embodiment above may have a configuration in which the first tapered roller bearing 410 and the second tapered roller bearing 420 are inclined such that the closer the first tapered roller bearing and the second tapered roller bearing are to each other, the greater a distance between the rotation axis 415 of the tapered roller bearing 412 and the input gear shaft 324.

In each of the above preferred embodiments, a fixing mechanism 340 that fixes the input gear shaft 324 of the input gear 320 at a predetermined position in the upper-lower direction with respect to the gear case 302 or the integral case 402 is illustrated as the fixing mechanism, but the fixing mechanism may fix the output gear shaft 334 of the output gear 330 at a predetermined position in the upper-lower direction with respect to the gear case 302 or the integral case 402. This configuration can reduce or prevent the thrust load on the connecting member (e.g., drive shaft 133) connected to the output gear shaft 334.

In the above preferred embodiments, in the casing 116, the lower case **116*b* is rotatably connected to the upper case 116*a*, but the lower case 116*b* does not necessarily have to be rotatable. The casing 116 need not include an upper case 116*a* and a lower case 116*b*** but may be a single member.

In the above preferred embodiments, the outboard motor 100 is provided with the water pump 140 as a driven device, but it may not be provided with the water pump 140 or may be provided with another driven device instead of the water pump 140.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an electric motor including an output shaft extending in an upper-lower direction;

a first helical gear below the electric motor and including a first gear shaft extending in the upper-lower direction and including a first end connected to the output shaft of the electric motor;

a first bearing to support the first end of the first gear shaft;

a second bearing to support a second end of the first gear shaft;

a second helical gear including a second gear shaft extending in the upper-lower direction and meshing with the first helical gear;

a case accommodating at least the first helical gear, the first bearing, and the second bearing; wherein at least one of the first bearing or the second bearing defines a fixing mechanism to fix the first gear shaft at a predetermined position in the upper-lower direction with respect to the case when the first and second helical gears rotate;

the fixing mechanism includes the second bearing, and the second bearing includes a first angular bearing and a second angular bearing positioned back to back with respect to the first angular bearing; and the first angular bearing and the second angular bearing are fixed to the case and to the second end of the first gear shaft in the upper-lower direction.

2. The outboard motor according to claim 1, wherein the second bearing includes a double row angular bearing.

3. The outboard motor according to claim 2, wherein the case includes a contact surface that contacts one end surface of the double row angular bearing in the upper-lower direction; and the second end of the first gear shaft includes a protruding portion that sandwiches the double row angular bearing with the contact surface in the upper-lower direction.

4. The outboard motor according to claim 1, further comprising a motor case, separate from the case, to accommodate the electric motor.

5. The outboard motor according to claim 1, wherein the case accommodates the electric motor.

6. A boat comprising:

a hull; and the outboard motor according to claim 1 mounted to a rear portion of the hull.

7. An outboard motor comprising:

a drive source;

a first gear below the drive source and including a first gear shaft including a first end connected to an output shaft of the drive source, the first gear being a helical gear or a bevel gear;

a second gear including a second gear shaft including a first end, the second gear meshing with the first gear and being a helical gear or a bevel gear;

a first bearing to support the first end of the first gear shaft or the first end of the second gear shaft;

a second bearing to support a second end of the first gear shaft or a second end of the second gear shaft; and a case to accommodate at least the first gear, the second gear, the first bearing, and the second bearing; wherein at least one of the first bearing or the second bearing defines a fixing mechanism to fix the first gear shaft or the second gear shaft to the case at a predetermined position in an axial direction of the first gear shaft or an axial direction of the second gear shaft when the first gear and the second gear rotate;

the fixing mechanism includes the second bearing, and the second bearing includes a first angular bearing and a second angular bearing positioned back to back with respect to the first angular bearing; and the first angular bearing and the second angular bearing are fixed to the case and to the second end of the first gear shaft in the upper-lower direction.

* * * * *